United States Patent [19]

Opel

[11] Patent Number: 4,593,936

[45] Date of Patent: Jun. 10, 1986

[54] UNIVERSAL CREDIT CARD

[76] Inventor: George E. Opel, 4031 Kottle Dr., Lafayette Hill, Pa. 19444

[21] Appl. No.: 586,857

[22] Filed: Mar. 6, 1984

[51] Int. Cl.[4] ..... B42D 15/00

[52] U.S. Cl. ..... 283/112; 283/83; 283/904

[58] Field of Search ..... 101/17, 32, 369, 395; 283/75, 76, 107, 108, 109, 110, 111, 112, 904

[56] References Cited

U.S. PATENT DOCUMENTS 1,951,596 3/1934 Creesy ..... 283/904

3,434,414 3/1969 Wright ..... 283/904

4,443,027 4/1984 McNeely et al. ..... 283/83

*Primary Examiner*—Paul A. Bell

*Attorney, Agent, or Firm*—Paul & Paul

[57] ABSTRACT

A universal credit card is disclosed that allows a purchaser to make a credit purchase and select any one of a number of pre-established credit lines to charge the purchase to. After an imprint is made from the universal card, a number corresponding to the proper credit line is manually entered onto the charge slip in an array of dots imprinted from the credit card.

6 Claims, 3 Drawing Figures

UNIVERSAL CREDIT CARD

BACKGROUND OF THE INVENTION

This invention is for use by credit card holders. More particularly, this invention allows credit card holders with a multiple number of credit cards to use one card in the place of all others.

The American economy, over the years in the 20th Century, has slowly but surely changed into an economy centered on credit. As a business man travels from his banks to department stores to gas stations to restaurants, the credit card that is acceptable at each one of those institutions is different in most cases from the other cards that he must carry. As a business person travels throughout this country, from state to state, or throughout the world, from country to country, he or she is more and more burdened by the large number of various types and styles of credit cards that he must carry with him.

It is known to carry credit cards that are backed by large banking organizations. Cards such as a Visa or MasterCard are but two of the examples of this modern form of credit card. Although these cards are useful in a wide variety of situations, for example purchasing goods at a store or lodging at a hotel or inn, it is not uncommon for a single individual to have three or four of each of these types, each being issued by a different bank.

Another problem that may exist is when a card is first issued, a small figure, for example $500 or $600, is established as a line of credit. However, as time proceeds and the individual proves to be a good credit risk, that line of credit is expanded to an amount $2,000 to $5,000. It is very often difficult, when one person has four or five Visas or MasterCards, for that person to remember what credit limit applies to which card. More times than not, for a particularly large purchase, an individual might at first try to use a card that does not have sufficient credit on it, to the embarrassment of the card holder, even though he does have two or three other cards that do have sufficient credit on them.

Even though a person can get a bank credit card, this does not preclude the use of three or four cards from typically local establishments. While in the most part these establishments are department stores, and usually very large department stores at that, they are regional in their use. Therefore, a person traveling from the East Coast to the West Coast would find that he or she could no longer make purchases in a well-known department store on the West Coast because his credit reputation is known only to the East Coast department stores.

SUMMARY OF THE INVENTION

The instant invention is a universal credit card. It is of the usual plastic and milar composition and typical dimensions that ordinary credit cards are of but has on both surfaces a protective, very thin, transparent covering to protect the information stored underneath. The information stored underneath the covering is divided into five categories: photographic information; information encoded on a magnetic tape; printed information; written information; and embossed or raised-figure information. On the front side of the credit card, identifying information is located: a color or black and white photograph of the card holder or an individual authorized by the card holder to use that card and the following information in raised or embossed figures: the name and current address of the card holder; a line of identifying numbers with a plurality of spaced apart dot arrays immediately to the left and to the right thereof that allows the inscription of at least seven other digits; and the expiration date of the card. On the back side of the credit card is a strip of magnetic tape with credit information encoded therein and a printed list of all the organizations that are currently granting credit to the card holder alongside a sequence of two digit numbers to specifically identify each organization. The credit card holder's signature in ink is on the back side of the card on a piece of specially prepared material.

OBJECTS OF THE INVENTION

It is therefore an object of the present invention to provide a universal credit card for use by individuals who already have an established credit reputation.

It is a further object of the present invention to provide a universal credit card that has a current photograph and identifying number next to the name of the individual.

It is a still further object of the present invention to provide a universal credit card with an area to the left and to the right of the identifying number that will allow a credit sales clerk to inscribe further identifying digits on the card charge slip.

It is a still further object of the invention to provide a universal credit card that will carry in magnetically coded information a list of institutions currently providing credit to the credit card holder.

It is a still further object of the invention to provide a universal credit card that will provide a list of the institutions currently granting credit to the individual.

It is a still further object of the invention to provide a method for using the universal type credit card. Other objects and advantages of the present invention will be readily apparent to those skilled in the art by reading the following brief description of the drawings, detailed description of the preferred embodiment, and the appended claims.

DESCRIPTION OF THE PREFERRED EMBODIMENT

Figure 1:
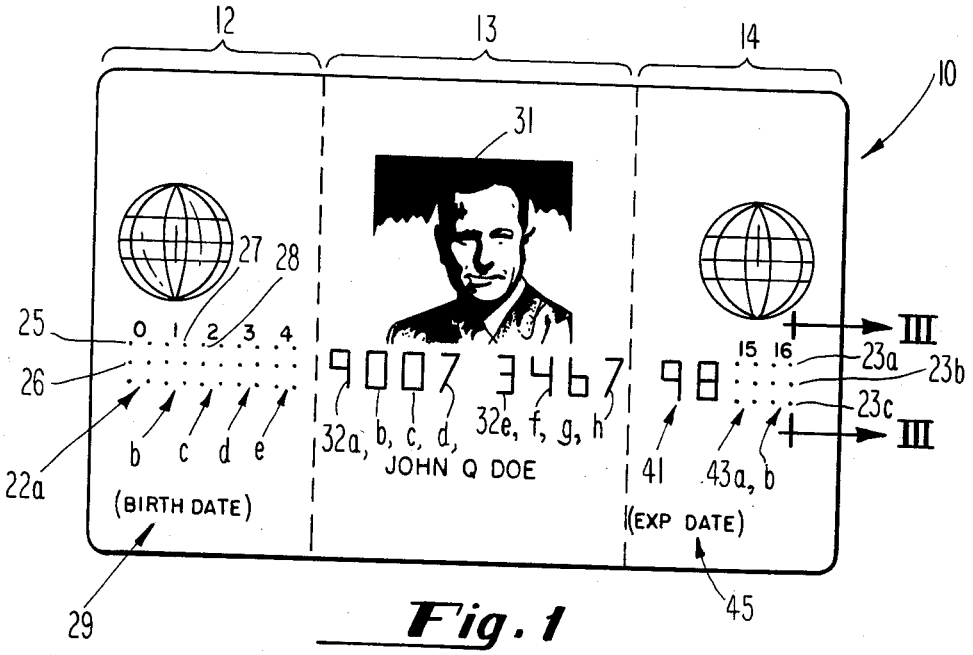
FIG. 1 shows a plan view of the front side of the universal credit card.

FIG. 1 shows a plan view of the front side 11 of a universal credit card 10.

Card 10 has three information sections to store relevant data; namely, a left sector 12, a central sector 13, and a right sector 14. The information stored in each sector will be described below.

Figure 2:
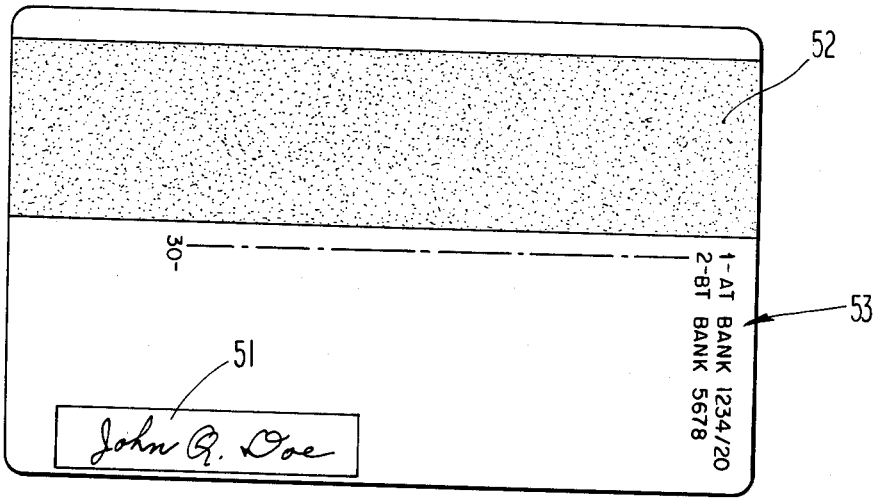
FIG. 2 shows a plan view of the back side of the credit card.
Figure 3:
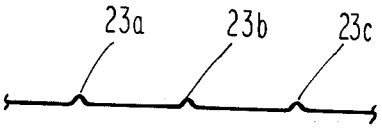
FIG. 3 shows a side view of the credit card taken along III—III.

Card 10 is of the normal size of credit cards, i.e., $3\frac{3}{8}$ inches long by $2\frac{1}{8}$ inches wide, however, these dimensions should not serve to limit any particular card. FIG. 2 shows a plan view of the back side of card 10, and FIG. 3 shows a side view of card 10 taken along III—III of FIG. 1.

Card 10 is an all-plastic, multiple-layer credit card as is known in the art. There are two, very thin, external layers of clear polyester film enveloping a polyethylene or polyester, data-containing insert. As is done in the industry, these two external layers are heat-bonded or laminated to the insert, thus sealing the data inside.

As seen in FIG. 1, the front side is divided into three sectors, 12, 13, 14. Each sector is configured for specific bits of data. Sector 12 has a plurality of 3×2 dot arrays 22*a, b, c, d* and *e* on it. The individual dots, in dot arrays 22 are of a predetermined size and thickness, and are therefore raised high enough off the surface of the front side to form noticeable protrusions, or bumps, such as at 23*a, b* and *c* (see FIG. 3) on the front surface for a purpose to be described below. The spacing between any two individual dots, such as between 25 and 26 or between 27 and 28, is of a predetermined distance for a purpose to be described below. Optionally, sector 12 can have a birth date 29 printed on it.

Sector 13 includes a photo 31 of the individual or individuals (not shown) authorized to carry card 10 and a plurality of numbers 32*a, b, c, d, e, f, g* and *h* that rise above the front surface in the same manner as arrays 23. Photo 31 is used as a source of identification and is affixed to the data insert before the clear polyester film is joined thereto. Numbers 32*a–h* are also for identification of the card holder and are predetermined.

Sector 14 includes also for identification purposes, a combination of numbers 41 and dot arrays 43*a, b* constructed on the insert in identical fashion as are numbers 32 and arrays 22. Similarly, numbers 41 and arrays 43 rise above the front surface as do numbers 32 and arrays 22. It is to be understood that the above description of placement of dot arrays and numbers is for illustrative purposes only and is not limited to the combination described. Optionally, as with date 29, an expiration date 45 is printed on sector 14.

FIG. 2 shows a plan view of the back side of card 10. The back side carries data in the form of a strip of material 51 whereon the card holder's signature is recorded, as is known in the art, and a strip of magnetically encoded material 52, as is known in the art, for credit data 53 such as authorized charge accounts and credit lending institutions. Signature strip 51 and magnetic strip 53 can be either beneath the bottom clear cover or adheringly affixed to it once the lamination process is completed.

METHOD OF OPERATION

The universal credit card 10 is carried by a person in lieu of other credit cards. Credit data from the card holder's accounts is consolidated and authorized accounts are listed on strip 52. As stated above, the authorized signature of the card holder is recorded onto strip 51. The card holder's photograph, birth date, the card expiration date and a unique set of numbers are all affixed to the front side of the insert and the front and back layers laminated thereto.

At the point of purchase, the cashier would make an imprint of card 10 on a charge slip, using standardized imprint devices, as is known in the industry. The imprinted slip would now carry the dot array patterns 22 and 43 and the numbers 32. After varifying that the picture 31 was identical to the card holder, the cashier would check to insure that the card holder had credit balances at the entities listed on strip 52. When the card holder signs the charge slip, that signature would be compared to the authorized signature on strip 51. After all checks were completed, the card holder would choose a credit source from the verified list on the backside 17 and the corresponding two-digit number filled in with a pen or similar instrument between the dots 43 *a, b*. To complete the transaction, the cashier then enters the store or restaurant's authorizing code, one number per space in between dots 22*a–e*. The normal distribution of copies of the charge slip is then made.

Obviously, many modifications and variations of the present invention are possible in light of the above teachings, and, it is therefore understood that, within the scope of the disclosed inventive concept, the invention may be practiced otherwise than specifically described.

1. A credit card comprising:

a rectangular card of predetermined dimensions having a front side and a back side;

a photographic image adheringly attached to said front side;

identification indicia embossed on said front side so as to be reproduced on an imprinted charge slip consisting of:

a. a pre-selected number; and b. a plurality of spaced apart dot arrays adjacent said pre-selected number, wherein the spacing of said dots is predetermined so as to define, when a charge slip is imprinted, a plurality of spaced apart dot array patterns on the slip, each such pattern being suitable for entry of a character.

2. A credit card as in claim 1 wherein a strip of predetermined material able to accept for permanent display, an individual signature thereon is adheringly attached to said back side.

3. A credit card as in claim 2 wherein said front and said back sides are each protected by fixedly attached, transparent overlays.

4. A credit card as in claim 1 wherein a strip of predetermined material able to accept for permanent recording electronically encoded information is adheringly attached to said back side.

5. A credit card as in claim 4 wherein said front and said back sides are each protected by fixedly attached, transparent overlays.

6. An improved credit card, made of plastic or similar material with transparent overlays protecting an insert and having a front side with a photo and raised numerals thereon and a back side having a strip of magnetically encoded information thereon, the improvement comprising: additional identification indicia embossed on said front side so as to be reproduced on an imprinted charge slip consisting of:

a. a plurality of preselected numbers; and b. a plurality of spaced apart dot arrays adjacent said preselected numbers, wherein the spacing of said dots is predetermined so as to define, when a charge slip is imprinted, a plurality of spaced apart dot array patterns on the slip, each such pattern being suitable for entry of a character.

* * * * *